US006607844B1

(12) United States Patent
Araga et al.

(10) Patent No.: US 6,607,844 B1
(45) Date of Patent: Aug. 19, 2003

(54) ZN-MG ELECTROPLATED METAL SHEET AND FABRICATION PROCESS THEREFOR

(75) Inventors: Kuniyasu Araga, Kakogawa (JP); Hiroo Shige, Kakogawa (JP); Masatoshi Iwai, Kakogawa (JP); Takeshi Watase, Kakogawa (JP); Yutaka Kitou, Kakogawa (JP)

(73) Assignee: Kobe Steel, Ltd., Kobe (JP)

( * ) Notice: Subject to any disclaimer, the term of this patent is extended or adjusted under 35 U.S.C. 154(b) by 0 days.

(21) Appl. No.: 09/522,107

(22) Filed: Mar. 9, 2000

(30) Foreign Application Priority Data

Mar. 15, 1999 (JP) ..... 11-069071
Dec. 17, 1999 (JP) ..... 11-359028

(51) Int. Cl.[7] ..... B32B 15/00; B32B 15/04; C25D 15/00; C25D 3/22

(52) U.S. Cl. ..... 428/624; 428/626; 428/658; 428/666; 428/687; 205/109; 205/305

(58) Field of Search ..... 428/658, 649, 428/621, 655, 659, 687, 613, 614, 634, 457, 469, 626, 935, 624, 666, 220, 332, 337; 205/102, 112, 109, 152, 149, 155, 305, 311, 312, 313, 314

(56) References Cited

U.S. PATENT DOCUMENTS

| | | | | | |
|---|---|---|---|---|---|
| 4,610,937 | A | * | 9/1986 | Ito et al. | 428/659 |
| 4,659,631 | A | * | 4/1987 | Kurimoto et al. | 428/624 |
| 4,904,544 | A | * | 2/1990 | Mori et al. | 428/658 |
| 5,002,837 | A | | 3/1991 | Shimogori et al. | 428/621 |
| 5,021,301 | A | * | 6/1991 | Nakakoji et al. | 428/659 |
| 5,135,817 | A | | 8/1992 | Shimogori et al. | 428/621 |
| 5,207,840 | A | * | 5/1993 | Riesop et al. | 148/260 |
| 5,648,177 | A | * | 7/1997 | Fukui et al. | 428/610 |
| 5,650,238 | A | * | 7/1997 | Urakawa et al. | 428/648 |
| 5,853,850 | A | | 12/1998 | Iwai et al. | 428/148 |
| 6,465,114 | B1 | * | 10/2002 | Honda et al. | 428/659 |

FOREIGN PATENT DOCUMENTS

| | | | |
|---|---|---|---|
| EP | 0 424 856 | | 5/1991 |
| EP | 0 730 045 | | 9/1996 |
| JP | 58-144492 | * | 8/1983 |
| JP | 64-17852 | | 1/1989 |
| JP | 6-33263 | | 2/1994 |
| JP | 8-3728 | | 1/1996 |
| JP | 8-13186 | | 1/1996 |
| JP | 8-134632 | | 5/1996 |
| JP | 9-195871 | | 7/1997 |

OTHER PUBLICATIONS

Derwent Publications, AN 1983–780034, JP 58 144492, Aug. 27, 1983.

* cited by examiner

*Primary Examiner*—Michael La Villa
(74) *Attorney, Agent, or Firm*—Oblon, Spivak, McClelland, Maier & Neustadt, P.C.

(57) ABSTRACT

Provided are a Zn—Mg electroplated metal sheet excellent in corrosion resistance, formability and productivity, and a fabrication process therefor. The Zn—Mg electroplated metal sheet comprises a Zn—Mg electroplated layer including Mg and Zn, the Zn being a main component, formed on at least one surface of a metal substrate material. The Zn—Mg electroplated layer shows more excellent corrosion resistance by including a C component therein. The Zn—Mg electroplated metal sheet can be fabricated by performing electroplating with an acidic aqueous solution including metal salts of Zn and Mg, and in addition, a surface active agent.

20 Claims, No Drawings

ZN-MG ELECTROPLATED METAL SHEET AND FABRICATION PROCESS THEREFOR

BACKGROUND OF THE INVENTION

1. Field of the Invention

The present invention relates to a Zn—Mg electroplated metal sheet and a fabrication process therefor and particularly, a Zn—Mg electroplated metal sheet showing excellent corrosion resistance suitable for use industrial fields such as of construction materials, household electric appliances, automobiles and others, and a fabrication process therefor. Metal substrate materials on which electroplating is performed in the present invention include Fe and Fe based alloys, and in addition nonferrous metals such as Cu, Al and Ti, and alloys thereof, wherein there is no specific limitation on shapes thereof, but any of a flat sheet and a corrugated sheet, which are primarily named, and a pipe, a rod and so on can be employed. Below, the present invention will be described of a case of a steel sheet as a metal substrate material, which is a typical substrate material.

2. Description of Related Art

In industrial fields such as of construction materials, household electric appliances, automobiles and others, Zn plated steel sheets have generally been employed as corrosion resistance means for a steel sheet or the like sheet and as fabrication processes for the Zn plated steel sheets, hot dip plating, electroplating and vapor deposition plating have widely been adopted. Various kinds of Zn plated steel sheets have been developed according to combinations of Zn alloy compositions and plating methods, and among them, a Zn—Mg alloy vapor deposition plated steel sheet (for example, JP-A-89-17852, JP-A-96-134632, JP-A-96-3728 and JP-A-97-195871) has been known as being excellent in corrosion resistance.

In recent years, a demand for improving corrosion resistance of steel sheets and so on has increasingly been on the upward move. While it is conceived to simply increase a coating weight on a steel sheet in order to improve corrosion resistance thereof, cost is always raised in company with such an improvement since a plating time is longer, or more of energy is consumed to realize more of vaporization of a plating metal, thus affecting the cost of fabrication upward. Since the vapor deposition plating method inherently requires a giant vacuum facility and others, a fabrication cost thereof is very high compared with any of other processes, making the further cost rise a fatal problem for the method. Further, since Mg is a metal of sublimation and vapor thereof is generated directly from the solid surface with no liquid phase interposed prior to the vaporization, a vaporization speed inevitably changes over elapsed time, which in turn makes stable control of a coating weight and a composition very hard. Besides, there has been available no established supply method suitable for its continuous operation, which is another problem in an aspect of the actual operation.

On the other hand, in a hot dip plating method, since a coating weight of the method is inherently large, if the coating weight is larger than in the current state, it causes troubles such as galling or flaking in press molding of a plated steel sheet. Furthermore, in more cases of the hot dipping method, a temperature of a plating bath has to be higher than a melting point of pure Zn and a fragile alloy layer including Fe is generated on the boundary surface of a substrate steel sheet, leading to a further problem since the plated layer is peeled off with ease in a forming process.

Furthermore, in a case of Zn—Mg alloy plating, if an electroplating method (using a normal aqueous solution) was adopted, Mg itself could not be deposited since a normal electrode potential of Mg is greatly low. However, if the Zn—Mg alloy plating can be performed with the electroplating process, a composition of components of the alloy and a coating weight thereof can be controlled with ease by properly controlling amounts of metal ions included in a plating solution, ratios of the metal ions, an over-potential (cathodic current density), a current amount and so on. Further, since no step of high temperature is included in the electroplating process, there is no risk that a fragile intermetallic compound and so on are formed at the interface between the plated layer and the substrate surface and in turn an interlayer adhesive force is reduced as well. Still further, consumed metal ions are supplemented from the cathode, which is soluble, or can be replenished as a solution including the metal ions from outside of the system when a non-soluble cathode is employed, which makes the electroplating method suitable for use in the continuous fabrication on an industrial scale.

If the Zn—Mg electroplated layer can be formed in such a way, it is conceived that steel sheets excellent in corrosion resistance can be fabricated with good productivity and no loss of formability. Hence, there has been built up a desire of development of a fabrication process for a Zn—Mg electroplated layer by means of an electroplating method.

SUMMARY OF THE INVENTION

The present invention has been made in light of the above described circumstances and it is accordingly an object of the present invention to provide a Zn—Mg electroplated metal sheet excellent in corrosion resistance, formability and productivity, and a fabrication process therefor.

A Zn—Mg alloy plated metal sheet of the present invention, which achieves the object, has a Zn—Mg electroplated layer including Mg and Zn, the Zn being a main component, formed on at least one surface of a metal substrate material. Further, a carbon component (as an organic compound) is preferably included in the Zn—Mg electroplated layer since corrosion resistance is greatly improved due to inclusion of the C (carbon) component.

A Mg content in the Zn—Mg electroplated layer is preferably in the range of from 0.08 to 40% (% means wt %, which applies hereinafter) and a C component content in the Zn—Mg electroplated layer is preferably in the range of from 0.01 to 10% on the basis of the carbon element.

While the Zn—Mg alloy plated metal sheet according to the present invention exerts an excellent corrosion resistance (red rust resistance), it is recommended in order to be of excellent white rust resistance that a crystallographic orientation index of the (002) plane of an electroplated layer is equal to or lower than 1.0 and a crystallographic orientation index of the (100) plane of an electroplated layer is equal to or higher than 0.6.

Further, the Zn—Mg alloy plated metal sheet according to the present invention has an improvement of the effects of corrosion resistance after painting on the Zn—Mg electroplated layer, particularly the effects in defective portions of a coat such as a physical flaw portion of the paint or a cutting edge thereof (hereinafter simply referred to as edge as well) after painting as compared with a conventional painted galvanized metal sheet. In connection to the corrosion resistance in defective portions of a paint, the effects on corrosion resistance are further improved by controlling a deposition state of the electroplated layer or providing an intermediate layer between the electroplated layer and the paint.

A fabrication process for the Zn—Mg alloy plated metal sheet of the present invention, which achieves the object, performs electroplating using an acidic aqueous solution including metal salts of Zn and Mg, and in addition, a surface active agent, wherein a crystallographic orientation index of an electroplated layer is preferably controlled in order to increase chemical treatability thereof.

It should be appreciated that the surface active agent is desirably a nonionic or cationic surface active agent and a concentration thereof in the acidic aqueous solution is preferably in the range of from 0.01 to 30 g/L.

As the nonionic surface active agent or agents, there can be recommended in use one or more selected from the group consisting of polyethylene glycol, polyoxyethylene-alkylether and polyoxyethylene-polyoxypropylene-alkylether. As the cationic surface agent or agents, there is preferably used one or more selected from the group consisting of a primary amine, a secondary amine, a tertiary amine and a quaternary ammonium salt, and a heterocyclic compound, wherein especially in a case of the cationic surface active agent, a surface active agent is preferably one having one or more benzene rings.

Furthermore, in the present invention, electroplating may be performed at a current density in the range of from 50 to 1500 A/dm$^2$.

DETAILED DESCRIPTION OF THE PREFERRED EMBODIMENTS

Zn—Mg alloy plating could not be achieved by means of an ordinary electroplating method using water as a solvent of a plating solution, which is currently in wide spread use. The reason why is that since a normal electrode potential of Mg is −2.363 V, which is extremely lower than a hydrogen evolution potential in electrolysis of water, which is the solvent, and therefore almost all of energy supplied is consumed in a hydrogen evolution reaction, leading to no electro-deposition of Mg. Hence, it has heretofore been said that Mg is impossible to be singly electro-deposited from an aqueous solution.

In parallel to such a situation, a fabrication process for a steel sheet plated with a Zn—Mg alloy of a Mg content 35 wt % or more has been proposed, for example, in JP-A-96-13186, in which electroplating using a molten chloride salt bath is employed and a ratio in mol between zinc chloride and magnesium chloride in the molten chloride salt bath is adjusted. However, a reality is that such electroplating has not yet reached a level of practicality in forming a Zn—Mg electroplated layer on a metal sheet.

The present inventors have found that a Zn—Mg alloy plated layer can be formed by means of an electroplating method by including a specific organic compound (a non-ionic or cationic surface active agent) in a plating solution in addition to Zn and Mg, as a result of their serious studies on a method for achieving Zn—Mg electroplating using an aqueous solution and such a finding has led to the present invention. In the course of the studies, the present inventors have achieved a further finding that a Zn—Mg alloy plated layer formed by means of an electroplating method according to the present invention contains a carbon component as a third element originating from the organic compound present in an electrolytic solution and a Zn—Mg alloy plated layer of the present invention, which contains the carbon component, shows much more excellent corrosion resistance than a Zn—Mg binary alloy plated layer obtained by means of a vapor deposition plating method.

It should be appreciated that the term corrosion resistance employed herein includes resistance of an as-plated layer (with no coat thereon) to red rust generation and pitting corrosion, or resistance to red rust generation, white rust generation and paint blister generation on a painted plated layer in portions affected by physical flaws and on edges of a coated steel sheet.

A composition of constituents of a Zn—Mg electroplated layer of the present invention will be described: If a Mg content is too low, no Mg addition effect is exerted in a virtual sense and there is no recognizable difference especially in corrosion resistance from a plated layer singly made of Zn. Hence, a Mg content is desirably 0.08% or higher, more preferably 0.2% or higher and further more preferably 1% or higher. However, if a Mg content is too high, formability is degraded. Hence, a Mg content is preferably 40% or lower, more preferably 30% or lower and further more preferably 10% or lower. It should be appreciated that the reason why as a Mg content is higher, less of formability is resulted is estimated that a fragile intermetallic compound of Zn and Mg is produced a lot.

Then, if a carbon component content is lower than 0.01% on the basis of the C element, no effect of C component addition is recognized in a virtual sense; there arises no significantly recognizable difference in corrosion resistance from Zn—Mg binary alloy. Hence, a C component content is desirably 0.01% or higher and more desirably 0.05% or higher on the basis of the C element. However, if a C component content is 10% or higher, not only is appearance of a plated layer darkened, but powdery deposits are formed thereon, that is a "burnt surface" phenomenon occurs, thereby not only conspicuously degrading a value as commerce article, but reducing plating adhesiveness. Accordingly, a C component content is necessary to be 10% or lower, preferably 8% or lower and more preferably 5% or lower.

For measurement of a C component content ratio, a well known combustion infrared absorption method, a fluorescence X ray analysis method or the like may be adopted. For example, when the former is employed, a plated layer is previously dissolved in a sulfuric acid solution of a proper concentration (preferably in the range of from about 3 to about 10%) or the like solution and a carbon amount included in the solution is measured to determine the C component content ratio of the plated layer. Though the latter fluorescence X ray analysis realizes a non-destructive measurement, an influence of a C component included in a steel sheet requires to be corrected when the steel sheet is used as a substrate material. Considering such an inconvenience together with a measurement sensitivity, use of the combustion infrared absorption method is recommended.

As described above, in the present invention, very excellent corrosion resistance, which could not achieved by singly adding Mg or C, can be attained by a synergistic effect of Mg and C in combination.

Further, it is allowed that while a constituent element other than Mg and C is required to be mainly Zn, various kinds of metal elements, such as Ni, Co, Fe, Mn and others, and further, oxides, such as $SiO_2$, $Al_2O_3$ and others may be added, singly or in combination to form an eutectic mixture, from the viewpoint of improvement on formability, paintability, chemical treatability and weldability, and improvement on an antidarkening property and corrosion resistance.

While in the present invention, a plated layer can be used in an as-plated state with no finish coating because of being excellent in corrosion resistance and so on, it goes without saying that a variety of chemical treatments and paintings can be applied on the surfaces of the plated metal materials in expectation of further improvement on various kinds of performances such as corrosion resistance, physical flaw resistance, finger print resistance, formability and so on, which are requirements in practical use coming from actual needs. As concrete examples of such chemical treatments, there can be named: a chromate treatment, a phosphate treatment, a clear film treatment and others as being in general use.

To be more detailed, as representatives of the chromate treatments, the following are exemplified: a reactive chromate treatment, a coating chromate treatment, an electrolytic chromate treatment and others, and a chromate treatment is preferably adopted whose treatment solution includes a Cr compound as a main component and further, if necessary, various kinds of activators, for example a various kinds of oxides, such as silica and an organic silane compound, and further, phosphoric acid, nitric acid, a fluoride, a silicofluoride and other compounds in order to improve qualities such as corrosion resistance, physical flaw resistance and anti-darkening property.

Furthermore, in a case of thin clear film coating, wherein the clear film is mainly made of an organic resin, a treatment liquid may be one whose main component is an organic resin component, such as epoxy resin, polyester resin, polyurethane resin, ethylene copolymer including ethylenic unsaturated carboxylic acid as a polymerizable component, polyvinyl resin, polyamide resin or fluorocarbon resin, or alternatively, in order to improve qualities, such as corrosion resistance, a lubricating ability, physical flaw resistance, formability, weldability, electrodeposition-paintability and paint adhesion, there is exemplified a treatment liquid for the coating including, in addition to the above described organic resin components, various kinds of oxide powders such as silica, inorganic pigments such as various kinds of phosphates, wax particles, an organic silane compound and a naththenic acid salt, when a necessity arises.

In a case of thin clear film coating, wherein the clear film is mainly made of an inorganic material, a treatment liquid may be one whose main component is silicates such as sodium silicate, potassium silicate and lithium silicate, or alternatively, in order to improve qualities such as a film forming property, corrosion resistance, lubricating ability, physical flaw resistance, formability, weldability, electrodeposition-paintability and paint adhesion, there is exemplified a treatment liquid for the coating including, in addition to the above described silicates, various kinds of oxide powders, such as colloidal silica, inorganic pigments such as various kinds of phosphoric acids, wax particles, an organic compound and so on, when a necessity arises.

Further, in a case where painting is applied on the plated layer or on the chemical treatment film, painting may be of a single layer, of two layers (a primer and a top coat) or of three layers with no problem in selection of any of them. There is no specific limitation on a kind of a painting composition and ones suitable for household electric appliances, construction materials, automobiles and others can be used for the coat painting: there can be exemplified painting compositions such as acrylic resin based, melamine alkyd resin based, polyester resin based, epoxy resin based, polyvinyl chloride based (sol), fluorocarbon resin based, polyurethane resin based and polyamide resin based, and in addition, various kinds of modifications and mixture thereof. Furthermore, well known additives such as pigment, a matting agent, wax and so on can be adopted, if necessary, for the purpose of adjustment of color tone, impartment of effective appearance as design, improvement of formability or the like.

A painting method of the present invention has no specific limitation in selection as far as a paint thickness of the present invention can be ensured. For example, there can be exemplified well known methods such as bar coat method, a roll coat method, a spray method, an electrostatic painting method, a curtain flow coat method, a dip method and an electrodeposition painting method (a cationic electrodeposition painting method and an anionic electrodeposition painting method), and further in a case of double layer painting, combinations of the methods may be employed with no problem. Further, there is no specific limitation on ways of curing/cross-liking, but which may be selectively adopted so as to be suitable for a coating composition in use; well known curing/cross-inking methods can be selected in a proper manner: an ultraviolet curing/cross-linking method, an electron beam curing/cross-linking method and a room temperature curing/cross-linking method.

A coating weight of Zn—Mg—C composite alloy plating according to the present invention has no specific limitation thereon. However, since if a coating weight is less than 2 $g/m^2$, corrosion resistance in an as plated state is poor, it is desirably 2 $g/m^2$ or more and more desirably 5 $g/m^2$ or more. In a case where one or multiple layer of paint film are formed on the surface of a plated layer when in use, a coating weight of 0.5 $g/m^2$ or more is sufficient in exertion of corrosion resistance on the edge. Contrary to this, in case of a coating weight as high as to exceed 100 $g/m^2$, there arises troubles in formability and weldability and in addition thereto, poor cost effectiveness arises. Hence, it is necessary to set a coating weight of 100 $g/m^2$ or less, desirably 60 $g/m^2$ or less and more desirably 40 $g/m^2$ or less. Especially, in a case where one or multiple layer of paint film are formed as an upper layer of a plated layer, a coating weight is recommended to be 40 $g/m^2$ or less. Further, plating is only required to be applied on an necessary portion of the surface of a metal sheet as a substrate material: only one surface may be applied with plating or both surfaces may be applied therewith.

The chemical treatment film may be formed singly or in combination in various ways according to purposes. A preferable coating weight of the chemical treatment film is generally selected in the range of from 5 to 300 $mg/m^2$ not only in order to make an effect of improving corrosion resistance and others exerted effectively, but taking cost efficiency into consideration and further, a preferable coating weight of an inorganic or organic film is generally selected in the range of from 0.05 to 20 $\mu$m in thickness for reasons similar to the above described.

A thickness of a paint formed on a Zn—Mg-organic material composite plated layer is set in the range of from 1 $\mu$m to 200 $\mu$m, both limits included, and preferably in the range of 3 $\mu$Mm to 100 $\mu$m, both limits included. If a paint thickness is less than 1 $\mu$m, not only is an effect of improving corrosion resistance in a physical flaw portion and on an edge insufficient, but an effect of improving formability does not function sufficiently either. Further, even if a paint thickness exceeds 200 $\mu$m, not only are the effects of improving corrosion resistance in a physical flaw portion and on an edge saturated but cost increase is resulted.

Further, substrate materials used in a surface treated sheet of the present invention are mainly various kinds of cold rolled steel sheets employed for construction materials, household electric appliances, automobiles and so on. However, it is possible to select hot rolled steel sheets and metal sheets other than a steel sheet such as an aluminum sheet according to applications.

Then, detailed description will be made of a method for a Zn—Mg—C composite zinc alloy plating: A formation of a Zn—Mg plated film by means of an electroplating method can be realized such that nonionic or/and cationic surface active agents are added to a plating solution, in which water is employed as a solvent, together with salts of Zn and Mg. The surface active agent is not only indispensable in order to electro-deposit Mg but itself electro-deposited in a plated layer together with metals so that excellent corrosion resistance of the present invention is exerted. While the reason why Mg, which has been said to be impossible to be electro-deposited, can be electro-deposited is still under investigation, it is reasoned, though estimation, in the following way: That is, a surface active agent that has been added hinders an electrolytic reaction of water (a reduction process of hydrogen by the surface active agent adsorbed on a cathodic surface) and largely polarizes an over-voltage of hydrogen evolution, with the result that a cathodic surface potential reaches a deposition potential of Mg.

Nonionic and cationic surface active agents may be added singly or in combination. With any of both surface active agents, if a content in a plating solution is less than 0.1 g/L, neither a Mg content nor a C component content of the present invention can be achieved and therefore, the content is necessary to be 0.1 g/L or higher, preferably 0.2 g/L or higher and more preferably 0.4 g/L or higher. On the other hand, even if a surface active agent is added at a content exceeding 30 g/L, a Mg electro-deposition effect is not only saturated but a burnt surface phenomenon arises. Hence, the content is necessary to be 30 g/L or lower, preferably 20 g/L or lower and more preferably 15 g/L or lower.

While surface active agents of the present invention have no specific limitation as far as the agents are nonionic or cationic surface active agents, the following compounds are preferred as nonionic surface active agents: for example, polyethylene-glycol of a molecular weight 200 to 20000, polyoxyethylene-alkylphenylether expressed by $RO(CH_2CH_2O)_nH$ (wherein R is $C_8H_{17}$ or $C_9H_{19}$ and n is 2 to 30), polyoxyethylene-alkylether expressed by $RO(CH_2CH_2O)_nH$ (wherein n is 4 to 30) and polyoxyethylene-polyoxypropylene-alkylether expressed by $RO(CH_2CH_4O)_n(C_3H_6O)_mH$, $HO(C_2H_4O)_n(C_3H_6O)_m(C_2H_4O)_1H$ (wherein n:m is 1:5 to 200).

As cationic surface active agents, there can be exemplified as follows: a primary amine, a secondary amine, a tertiary amine and a quaternary ammonium salt, and a heterocyclic compound. As the primary amines, there can be exemplified as follows: aliphatic primary amines such as amines expressed by $R—H_2$ including ethylamine, propyl amine and dodecyl amine, or aromatic amines such as aniline, o-toluidine, m-toluidine, benzylaniline, α-naphthylamine and β-naphthylamine. As the secondary amines, there can be exemplified as follows: aliphatic secondary amines, such as amines expressed by R—NH—R including dimethylamine, dipropylamine and diisopropylamine or aromatic amines such as methylaniline, ethylaniline, dibenzylaniline and diphenylamine. Further, as the tertiary amines, there can be exemplified as follows: aliphatic tertiary amines expressed by RRRN including trimethyl amine, triethylamine, tripropylamine, tributylamine and triamylamine, or aromatic amines such as methylaniline, diethylaniline, tribenzylamine, triphenylamine and dimethylbenzylamine. As the heterocyclic compounds, there can be exemplified as follows: for example, five membered ring compounds such as pyrrol and thiazole; six membered ring compounds each including one nitrogen atom such as pyridine; six membered ring compounds each including two nitrogen atoms such as imidazole, pyrimidine and thymine; six membered ring compounds each including three nitrogen atoms such as triazole; compounds obtained by condensation of the heterocycles with a benzene ring such as indole, quinoline, mercaptobenzimidazole, mercaptobenzoxazole benzothiazole and benzotriazole; compounds obtained by condensation of heterocycles such as purine, pteridine, azabicycloheptane; polycyclic compounds such as hexamethylenetetramine; or derivatives thereof. Further, as quaternary ammonium salts obtained by reaction of alkyl halides with the tertiary amines, there can be exemplified as follows: for example, alkyltrimethylammonium halides such as stearyl trimethyl ammonium chloride, stearyltrimethyl ammonium bromide and lauryl trimethylammonium chloride; alkyldimethylbenzylammonium salts such as lauryldimethylbenzylammonium chloride and stearyldimethylbenzylammonium chloride; alkyltri(polyoxyethylene)ammonium halides such as tripentaoxyethylenestearylammonium chloride and tripentaoxyethylenelaurylammonium chloride; or as compounds in the form with 4 groups attached to a nitrogen atom, obtained by reaction of alkyl halides with the heterocyclic compounds, there can be exemplified as follows: for example, pyridinium halides such as pyridinium chloride; and alkylmethylpyridinium halides such as butylpicolinium chloride. Among the above described cationic surface active agents, compounds including one or more benzene rings are more preferable.

Further, as plating solutions, there can be named an acidic bath (for example, a sulfate bath and a chloride bath). Zn and Mg may be added to a plating solution as metal ions of sulfate, chloride, acetate, carbonate and so on in amounts that are incorporated into a plated film of a desired composition. Further, while a pH value of a plating solution can not be specialized, the pH value is preferably adjusted in the range of 0.1 to 2.0 in consideration of a current efficiency and a burnt a surface phenomenon. It should be appreciated that a conductivity assistant such as $Na_2SO_4$, $(NH_4)_2SO_4$, KCl and NaCl can be added to a plating solution with no problem in order to reduce power consumption by increasing conductivity of the plating solution.

Furthermore, a cathode current density (hereinafter simply referred to as current density) is especially in the range of 50 to 1500 A/dm$^2$ as a necessary plating condition. Since, to change a current density is to change a cathode surface potential, it is in accordance with the essential features of the present invention to control the current density to a proper value so as to bring a cathode surface potential to be close to the Mg deposition potential. That is, if the current density is less than 50 A/dm$^2$, a predetermined amount of Mg cannot be electro-deposited even with addition of a nonionic or/and cationic surface active agents of the present invention. Contrary to this, if the current density exceeds 1500 A/dm$^2$, a supply speed of metal ions to the cathode surface is apt to be delayed, which in turn causes a burnt surface phenomenon with ease. Simultaneously, a plating voltage is raised accompanying increase in power consumption, thereby entailing poor cost effectiveness. Accordingly, the current is preferably adjusted in the range of from 70 to 1000 A/dm$^2$ and more preferably in the range of from 100 to 800 A/dm$^2$.

Other plating conditions, for example, a plating solution temperature and a relative flow rate are not to be specifically limited but can properly be changed as far as no defects such as burnt surface arise. For example, the effects of the present invention were confirmed under plating conditions of the plating solution temperature in the range of from 30 to 70° C. and the relative flow rate in the range of from 0.3 to 5 m/s. The term relative flow rate is a difference in speed between a liquid flow and a steel sheet travel when considering a flowing direction of the solution and a traveling direction of the steel sheet which is a substrate material.

Further, there is no specific limitation on detailed procedures of a plating method, but plating substrate materials may be subjected to a pretreatment such as degreasing, pickling and so on and subsequently receive electroplating in a plating cell, vertical or horizontal according to a normal way. As the electroplating methods, there may be adopted well known methods such as a direct current (constant current) plating, a pulse plating method or the like.

It should be appreciated that since the present invention adopts an electroplating method using an aqueous solution, there is present no portion in the process which assumes a high temperature (the highest temperature is a boiling point of water), therefore an electroplated metal sheet according to the present invention has no risk that the electroplated metal sheet comes to have a fragile alloy layer at the interface between a plated layer and a substrate metal material and thereby reduction in an interlayer bonding force, with the result that excellent formability can be exerted. Further, in the present invention, since Mg is present in the aqueous solution as ions, a ion ratio in amount between Zn and Mg can be changed with ease and in company with this, a Mg content ratio in the plated layer can be controlled to a any desired value and in addition to this advantage, consumed metal ions can easily be supplemented in the form of an aqueous solution.

A Zn—Mg—C electroplated metal sheet obtained by means of the above described method is excellent in corrosion resistance, formability and productivity. It should be appreciated that the excellent corrosion resistance exerted by the Zn—Mg—C is evaluated in a neutral salt spray test as an elapsed time till generation of red rust. Even with the Zn—M—C electroplated layer in the neutral salt spray test, a time from when the salt spray test gets started, corrosion of the plated layer follows immediately after starting of the salt spray test, till white rust generates on the plated layer, the white rust being a corrosion product characteristically formed on a zinc plated layer, is several hours or shorter, similar to a case of other zinc plating. Therefore, when an excellent corrosion resistance to white rust, too, is intentionally ensured, a chemical treatment film is recommended to be formed on the surface of a plated layer, by performing a chemical treatment similar to a case of a zinc plated metal sheet.

As the chemical treatment, while there can be named a chromate treatment, a phosphate treatment and a thin clear film coating, it is very important to control crystallographic orientation of a plated layer in any of the treatments since a chemical treatability largely changes according to the crystallographic orientation of a plated layer. To be concrete, a crystallographic orientation index of the (002) plane of the electroplated layer is controlled to be desirably 1.0 or lower and a crystallographic orientation index of the (100) plane of the electroplated layer is controlled to be desirably 0.6 or higher.

Now, description will be made of a crystalline structure of a Zn—Mg—C composite alloy plated layer. As a result of X ray diffraction applied on a Zn—Mg—C composite alloy plated layer of the present invention, it was found that a crystalline structure of the plated layer was dominated by the η phase Zn independently of a Mg content ratio and a C component content ratio and there were further observed, in parts of the X ray diffraction spectrum, spectral peaks that were estimated as attributed to an oxide or a hydroxide of magnesium together with X ray diffraction peaks that are estimated as attributed to a Zn—Mg intermetallic compound.

Therefore, the present inventors calculated a crystallographic orientation index of crystallographic planes of the dominant η phase Zn in the following way:

(1) an intensity of a diffraction spectral peak of each crystallographic plane (hkl) of the η phase Zn that is measured by X ray diffraction is indicated by I (hkl).

(2) Then, an intensity of a diffraction spectral peak of each crystallographic plane (hkl) when a standard zinc powder is used is indicated by Is(hkl), wherein the suffix s means standard.

(3) From the intensity values, a crystallographic orientation index Ico(hkl) of a Zn—Mg—C composite alloy film is defined by the following expression, wherein the suffix co means crystallographic orientation:

$$Ico(hkl)=[I(hkl)/[I(002)+I(100)+I(101)+I(102)+I(103)+I(110)]]/[Is(hkl)/[Is(002)+Is(100)+Is(101)+Is(102)+Is(103)+Is(110)]]$$

It should be appreciated that while spectral peaks other than those of the η phase Zn have chances to be observed in parts of a diffraction spectrum of a Zn—Mg—C composite plated layer, the diffraction peaks other than those of the η phase Zn are neglected in calculation of the crystallographic orientation index since influences thereof on the calculation are small. The calculation were only performed on major spectral peaks of the (002), (100), (101), (102), (103) and (110) planes of the η phase Zn.

For example, reactivity of a chromate treatment especially has a close relation with the orientation index of a crystallographic plane (002) among those of crystallographic planes of the η phase Zn that are measured in the above described way and the reactivity of a chromate treatment is good in a case of $Ico(002) \leqq 1.0$. In addition, the reactivity has a relation with a (100) plane and the reactivity in the chromate treatment is further good in a case of $Ico \geqq 0.6$. The reason why is estimated that the (002) plane of the q phase Zn has a low reactivity since dissolution by an acid is hard to occur on the (002) plane of the η phase Zn due to being closely packed: the crystallographic orientation index of the (002) plane is high and the (002) plane prevails in a plated layer on a steel sheet since a reactivity of the plated layer with the major crystallographic orientation (002) is worsened in the chromate treatment. Further, likewise, it is conceived that since the (100) plane of the η phase Zn is a plane perpendicular to the closely packed plane, when a plated layer orientated with this plane is formed on a steel sheet, a chromate treatability is improved due to no presence of the (002) plane which is closed packed in the plated layer on the steel sheet.

While description of a chemical treatment has above been made of the chromate treatment which is a typical treatment for zinc, a reactivity of a Zn—Mg—C composite alloy plated layer of an orientation which satisfies the above described conditions (hereinafter referred to as a oriented Zn—Mg—C composite alloy plated layer) is also improved in other treatments than the chromate treatment, such as a phosphate treatment, a silicate treatment or a so-called non-chromate treatment, in which a titanium compound or a zirconium compound is employed. For example, in a case of the phosphate treatment, closely packed phosphate crystals are grown on the oriented Zn—Mg—C composite alloy plated layer and therefore, paint adhesion and corrosion resistance after painting is bettered. Further, in a case of the silicate treatment, in which the treatment is generally applied by coating, on the oriented Zn—Mg—C composite alloy plated layer, abetter white rust resistance can be obtained since a coated silicate creates a strong, hard film through a reaction with the plated layer than on a non-oriented Zn—Mg—C composite alloy plated layer which does not satisfies the above described conditions (hereinafter referred to as non-oriented Zn—Mg—C composite alloy plated layer), even if the non-oriented Zn—Mg—C composite alloy plated layer and the oriented Zn—Mg—C composite alloy plated layer have the same coating weights of silicate films. Furthermore, in cases of treatments with a titanium compound and a zirconium compound as well, the titanium compound and the zirconium compound coated on the oriented Zn—Mg—C composite alloy plated layers react therewith, with the result of good white rust resistance.

Besides, it is recommended that a clear film to a thickness of the order of 1 $\mu$m is further coated on the surface treated by the above described chemical treatment, that is a so-called thin clear film treatment is recommended. In this case as well, the thin clear film treatment imparts a good white rust resistance on the oriented Zn—Mg—C composite alloy plated layer as compared with on the non-oriented Zn—Mg—C composite alloy plated layer.

Further, a normal painting can be applied even after the above described chemical treatment. The oriented Zn—Mg—C composite alloy plated layer on which the normal painting has been applied after the above described chemical treatment shows good paint adhesion and good corrosion resistance after painting as compared with the non-oriented Zn—Mg—C composite alloy plated layer. As kinds of normal painting, there can be named: three-coat painting for automobiles including cationic electro-deposition painting, surfacer painting, finish painting; baking paint such as acryl based or melamine based for household electric appliances, epoxy based primer, and coil coating such as polyester based top coat, and in addition, powder painting, zinc rich primer and others.

Then, detailed description will be made of a method for a Zn—Mg—C composite alloy plating of a specific crystallographic plane orientation of the present invention.

In order to realize the Zn—Mg—C composite alloy plating, nonionic or/and cationic surface active agents are dissolved together with salts of Zn and Mg in a plating solution in which water is a solvent. The surface active agents, which are indispensable for electrodeposition of Mg, are electro-deposited in a plated layer together with metals, and effective for exertion of excellent corrosion resistance of the present invention, which is as described above.

There is another need to consider a flow rate of a plating solution in order to achieve a Zn—Mg—C composite alloy plated layer with specific plane orientations of Ico(002)$\leqq$1.0 and Ico(100)$\geqq$0.6 in addition to the above described conditions.

In a case of electroplating, a composition and crystalline structure of a plated layer are largely affected by supply of ions to the plating boundary surface, which is dependent on a flow rate of a plating solution. In a case of the Zn—Mg—C composite alloy plating, to be specific as to crystallographic orientations, as the flow rate is slowed, Ico(002) decreases, while Ico(100) increases, thereby reactivity in a chemical treatment increases.

However, as the flow rate of a plating solution is slowed, ion supply to the plating surface is smaller. When ion supply is not provided in a corresponding manner to a current density, normal crystal growth for plating is hard to be performed because of electrolysis of water and increase in the pH value at the plating surface in company with the electrolysis, which is resulted in generation of a plated layer in gray color with poor adhesion (so-called burnt surface). In a case where a composition of a plating solution, a bath temperature and a cathode current density are constant, if a flow rate is smaller than a value, the burnt surface occurs. When the flow rate is called a burnt-surface critical flow rate (Vb), a flow rate (V) of a plating solution in the Zn—Mg—C composite alloy plating naturally has to be V>Vb. On the other hand, as V increases, Ico(002) increases while Ico (100) decreases. Therefore, if V exceeds about three times of Vb, the crystallographic orientation indexes of a Zn—Mg—C composite alloy plated layer have a chance to fall outside the ranges of the present invention. Accordingly, a Zn—Mg—C composite alloy plated layer with crystallographic orientation indexes in the ranges of the present invention can be produced by controlling V/Vb in the range of from 1 to 3, only the upper limit included.

Further, corrosion resistance in physical flaw portions and on edges, and formability of a painted Zn—Mg—C composite alloy plated metal sheet according to the present invention are improved by forming a paint to a specific thickness. The reason why is not definite, but estimated as follows: Explaining an improvement effect of corrosion resistance in a case of a painted Zn plated steel sheet, it is said that a corrosion phenomenon occurring under a paint film starting a physical flaw portion of the paint normally propagates with an anodic reaction in which a Zn plated layer is dissolved as an leading edge of under-film corrosion. In the leading edge of corrosion, $Zn^{+2}$ produced through dissolution of Zn is further transformed into $Zn(OH)_2$ and $H^+$ ions by hydrolysis of $Zn^{+2}$. Since a pH value decreases due to production of $H^+$ ions, dissolution of Zn further progresses, which is finally resulted in paint blister on a great scale in an early stage. However, in a case of the present invention where Mg, which is an alkaline earth metal, is included in a plated layer in the forms of a metal, a hydroxide or an oxide, it is estimated that decrease in a pH value at the corrosion lading edge under a paint is greatly suppressed by dissolved Mg ions and a dissolution reaction of the plated layer is thereby retarded, which in turn leads to excellence in corrosion resistance (resistance to paint blister) in a physical flaw portion and on an edge. Furthermore, it is estimated that $Mg^{+2}$ ions have a function to stabilize a corrosion product of Zn and thereby, a stable, closely packed corrosion product layer is formed in exposed portions including a physical flaw portion and an edge, which leads to a possibility of great restriction on Zn white rust and Fe red rust generation. Besides, since C incorporated in a plated layer of the present invention originates from various kinds of surface active agents that are added into a plating bath as described later, the C has a high affinity with a paint applied on the plated layer and functions to realize a strong adhesion between the plated layer and the paint. As a result of the above described functions and actions, it is estimated that very excellent corrosion resistance is ensured in a physical flaw portion and on an edge of a painted, plated layer.

In regard to formability, it is estimated that a paint formed on a plated layer has a important role. That is, since a paint rich in ductility follows deformation of a substrate material with no breakage on a great scale in processing, it is conceivable that if peeling of a plated layer occurs due to poor adhesion between the substrate material and the plated layer, the plated layer can be retained as it is.

Corrosion resistance in a physical flaw portion and on an edge of a painted Zn—Mg-organic material composite alloy plated layer, especially resistance to paint blistering can further greatly be improved by depositing the plated layer on a substrate surface like islands dispersed in the ocean.

The reason why is estimated as follows: With deposition of a plated layer like islands, a paint is put in contact partly with a plated layer and partly with a substrate material. Although a dissolution reaction of the plated layer occurs at the corrosion leading edge similar to the above description, the substrate material surrounding the dissolution reaction assumes acathode during the dissolution of the plated layer and therefore, no dissolution occurs on the part of the substrate material. Hence, a paint portion in contact with the substrate material is retained in a sound condition and it is considered that under such circumstances, progress in paint blistering is extremely restricted as a whole.

For the above described reasons, a substrate exposed area ratio is in the range of from 5% to 85%, both limits included, and preferably in the range of from 10% to 80%, both limits included. If the substrate exposed area ratio is lower than 5%, an improving effect of corrosion resistance in a physical flaw portion and on an edge is hard to be exerted. On the other hand, if the substrate exposed area ratio is higher than 85%, an exposed area of the substrate material is too large and cathodic corrosion resistance ability is not distributed throughout the entire surface thereof and against the expectation, there is a case where paint blistering is encouraged in the physical flaw portion and on the edge.

A measuring method of a substrate exposed area ratio of the present invention has no specific limitation in selection, but any can be used as far as it can clearly discern between a plated portion and the substrate surface. For example, the following methods can be exemplified: A method in which observation of a substrate surface is conducted under a well known SEM (scanning electron microscope) and regions in which plated layers are present and regions in which no plated layer is present are discriminated judging from three-dimensional forms, to which results an image analysis is applied and; a method in which a well known EPMA (Electron Probe Micro Analysis) is applied in an area analysis, one element (for example Zn) of components constituting a plated layer and one element (for example Fe) of components constituting a substrate material other than the one element of the plated layer are analyzed and thereby, exposed regions of the substrate material can be discriminated with ease. The latter method is recommended from the viewpoint of easiness of discrimination, reliability and easy image analysis and the present inventors adopted this method in measuring of a substrate exposed area ratio.

Furthermore, if a chromate film or a phosphate film is incorporated as an intermediate layer between the Zn—Mg-organic material composite plated layer and a paint, adhesion between each of the plated layer and the substrate material, and the paint can be increased one step and as a result, more of improvement on corrosion resistance and formability can be of reality. Further, since a chromate film and a phosphate film are inherently a passive film, a protective effect of the films themselves can greatly be expected. An coating weight of the chromate film is preferably in the range of 5 to 300 Mg g/$m^2$ on the basis of metal Cr and more preferably in the range of from 10 to 200 mg/$m^2$ on the basis of metal Cr.

Further, as phosphate treatments, there can be exemplified: a reactive phosphate treatment, a coating phosphate treatment and an electrolytic phosphate treatment. As films formed, there can be exemplified: films including, as a main component, one or more selected from the group consisting of phosphoric acid compounds such as Zn phosphate, Mn phosphate, Ca phosphate, Al phosphate, Mg phosphate and Fe phosphate and in order to improve qualities such as paint adhesion after water immasion, physical flaw resistance and formability, it is also possible that in the film, metal elements such as Ni, Mn and Mg are included and further, various oxides such as silica and an organic silane compound can also be included if necessary. Coating weights of the phosphate films are preferably in the range of from 0.1 to 4 g/$m^2$ as a weight of a film and more preferably in the range of from 0.3 to 3 g/$m^2$. It should be appreciated that there is no restriction on performing a surface adjustment treatment in which the surface is put in contact with a treatment solution including Ti colloid and Ni colloid as a pretreatment of a phosphate treatment in order to improve reactivity of the phosphate treatment, achieve a homogeneous treatment or produce fine phosphate salt crystals. Further, there is no restriction on performing degreasing by alkali, an organic solvent or the like in order to remove stains on the plated surface prior to treatments including the above described chromate treatments.

Below, concrete descriptions will be made of constitution, and actions and effects of the present invention using examples. It should be understood that the descriptions are not intended to any restriction on the present invention, but carrying out of proper modifications or alterations thereof included in the technical features of the present invention all fall within the scope of the present invention.

EMBODIMENTS

Embodiment 1

Al killed cold rolled steel sheets fabricated in a normal way were used as plating substrate materials. The Al killed cold rolled steel sheets were degreased and pickled, and thereafter, subjected to electroplating using a sulfate bath under the below described conditions. In the plating solution, lauryldimethylbenzylammonium chloride (Catinal CB-50 made by Toho Kagaku Kogyo,) was added as a cationic surface active agent at a concentration shown in Table 1.

Electroplating Conditions

Plating Solution Composition:

| | |
|---|---|
| $ZnSO_4.7H_2O$ | 50~400 g/L |
| $MgSO_4.7H_2O$ | 50~400 g/L |
| $Na_2SO_4$ | 20~100 g/L |
| $H_2SO_4$ | 10~70 g/L |

current density: 30~2000 A/$dm^2$ plating bath temperature: 60±5° C.

plating solution flow rate: 0.5~5 m/sec electrode (anode): $IrO_x$ electrode coating weight: 20 g/$m^2$ Further, with no addition of an organic compound of the present invention, samples for comparison were prepared in a case of Zn—Mg binary alloy plated steel sheets under conditions similar to as described above and by means of a vapor deposition plating method.

Plated steel sheets with no coat thereon (as plated) were evaluated according to JIS Z2371 Methods of neutral salt spray testing. An area ratio of red rust generation at the time of an elapsed time of 240 hours after the test was judged according the below described evaluation levels. Further, a 180 degree adhesion bending test with a plated surface facing outward was performed for judgment of formability, and a cellophane adhesive tape (made by Nichiban Co., Ltd.) is then attached on a convex surface of a bending portion and peeled off to visually observe peeled pieces stuck on the tape and judge plating adhesiveness according to the below described evaluation levels. Thus obtained results are collectively shown in Table 1.

Corrosion resistance evaluation levels

◎: 0%

○: less than 10%

Δ: equal to or more than 10 and less than 50%

X: 50% or more plating adhesiveness (formability) evaluation levels

○: no peeling or peeling at a level of no problem in practical use

X: much of peeling

TABLE 1

| No. | Additive amount of surface active agent g/L | Plating conditions: current density A/dm$^2$ | Composition of plating film: Mg content wt % | Composition of plating film: C content wt % | Performance evaluation: Corrosion resistance | Performance evaluation: Plating adhesiveness | Category |
|---|---|---|---|---|---|---|---|
| 1 | 0.5 | 50 | 0.08 | 0.02 | ○ | ○ | Present invention examples |
| 2 | 0.5 | 100 | 0.14 | 0.04 | ○ | ○ | |
| 3 | 0.5 | 150 | 0.23 | 0.07 | ◎ | ○ | |
| 4 | 0.5 | 250 | 0.38 | 0.06 | ◎ | ○ | |
| 5 | 0.5 | 500 | 0.64 | 0.16 | ◎ | ○ | |
| 6 | 0.5 | 750 | 3.5 | 0.23 | ◎ | ○ | |
| 7 | 0.5 | 1000 | 9.1 | 0.3 | ◎ | ○ | |
| 8 | 0.5 | 1500 | 15 | 0.28 | ◎ | ○ | |
| 9 | 1.0 | 150 | 0.56 | 0.21 | ◎ | ○ | |
| 10 | 1.0 | 150 | 1.1 | 0.24 | ◎ | ○ | |
| 11 | 1.0 | 150 | 2.1 | 0.21 | ◎ | ○ | |
| 12 | 1.0 | 250 | 6.0 | 1.1 | ◎ | ○ | |
| 13 | 1.0 | 250 | 13 | 1.3 | ◎ | ○ | |
| 14 | 3.0 | 250 | 25 | 4.6 | ◎ | ○ | |
| 15 | 3.0 | 500 | 32 | 2.7 | ◎ | ○ | |
| 16 | 3.0 | 500 | 38 | 8.3 | ◎ | ○ | |
| 17 | 0.3 | 150 | 1.0 | 0.03 | ○ | ○ | |
| 18 | 0.6 | 150 | 1.1 | 0.06 | ◎ | ○ | |
| 19 | 1.0 | 150 | 1.2 | 0.26 | ◎ | ○ | |
| 20 | 1.5 | 150 | 1.1 | 1.1 | ◎ | ○ | |
| 21 | 3.0 | 150 | 1.3 | 3.7 | ◎ | ○ | |
| 22 | 10 | 150 | 1.1 | 5.8 | ◎ | ○ | |
| 23 | 30 | 150 | 0.8 | 9.0 | ◎ | ○ | |
| 24 | 3.0 | 30* | 0.05* | 0.13 | Δ | ○ | Comparative examples |
| 25 | 3.0 | 2000* | 44* | 8.5 | ◎ | x | |
| 26 | 0* | 250 | 0* | 0* | x | ○ | |
| 27 | 35* | 150 | 1.4 | 12* | ◎ | x | |
| 28 | Vapor | — | 0.51 | 0* | x | ○ | Conventional example |
| 29 | deposition | — | 1.0 | 0* | x | ○ | |
| 30 | method | — | 3.5 | 0* | Δ | ○ | |

(Note) 1.* mark shows that conditions are outside those of the present invention.

As is apparent from Table 1, Examples Nos. 1 to 23 including Mg and C in plated layers in the ranges of the present invention show excellent corrosion resistance and plating adhesiveness (formability). In contrasts, Comparative examples Nos. 24 to 27 whose contents of Mg and C in plated layers fall outside the ranges of the present invention are inferior to Examples Nos. 1 to 23 on either corrosion resistance or plating adhesiveness. Among them, no Mg was able to be deposited in Comparative Example No. 26 in whose process no cationic surface active agent was added.

In addition, plated layers fabricated by means of the vapor deposition method shown in Conventional examples Nos. 28 to 30 included no C in the layers, and corrosion resistance thereof were inferior to those of Examples 4 to 6 of the present invention which had a Mg content in the plated layer similar to those of Conventional Examples Nos. 28 to 30.

Embodiment 2

Various surface active agents shown in Table 2 were added to plating-solutions and plated layers were fabricated by Zn—Mg—C composite alloy plating. Substrate materials and plating conditions were the same as those of Embodiment 1.

Thus obtained plated steel sheets were subjected to evaluation on corrosion resistance and plating adhesion in the same method as in Embodiment 1. Results are shown in Table 2.

TABLE 2

| No. | Surface active agent: Ionization | Surface active agent: Compound | Composition of plating film: Mg content wt % | Composition of plating film: C content wt % | Performance evaluation: Corrosion resistance | Performance evaluation: Plating adhesiveness | Category |
|---|---|---|---|---|---|---|---|
| 31 | Nonionic | Polyethyleneglycol (average molecular weight: 200) | 0.09 | 0.06 | ○ | ○ | Present invention examples |
| 32 | Nonionic | Polyethyleneglycol (average molecular weight: 4000) | 0.13 | 0.05 | ◎ | ○ | |
| 33 | Nonionic | Polyethyleneglycol (average molecular weight: 20000) | 0.11 | 0.21 | ◎ | ○ | |
| 34 | Nonionic | Polyoxyethyleneoctylphenylether, | 0.17 | 0.08 | ◎ | ○ | |
| 35 | Nonionic | Polyoxyalkylenealkylphenylether | 0.08 | 0.18 | ◎ | ○ | |
| 36 | Nonionic | Polyoxyethylenelaurylether | 0.19 | 0.18 | ◎ | ○ | |
| 37 | Nonionic | Polyoxyethylenepolyoxypropyleneether | 0.25 | 0.13 | ◎ | ○ | |
| 38 | Cationic | Alkylpicolium chloride | 0.84 | 0.47 | ◎ | ○ | |
| 39 | Cationic | Lauryltrimethylammonium chloride | 0.65 | 0.40 | ◎ | ○ | |

TABLE 2-continued

| No. | Surface active agent: Ionization | Surface active agent: Compound | Composition of plating film: Mg content wt % | Composition of plating film: C content wt % | Performance evaluation: Corrosion resistance | Performance evaluation: Plating adhesiveness | Category |
|---|---|---|---|---|---|---|---|
| 40 | Cationic | Lauryldimethylbenzylammonium chloride | 0.20 | 0.08 | ⊙ | ○ | |
| 41 | Cationic | Dimethylbenzylamine | 0.82 | 0.32 | ⊙ | ○ | |
| 42 | Cationic | Quinoline | 0.79 | 0.25 | ⊙ | ○ | |
| 43 | Cationic | Hexamethylenetetramine | 0.93 | 0.35 | ⊙ | ○ | |
| 44 | Anionic | Laurylammonium sulphate | 0* | 1.1 | x | ○ | Comparative |
| 45 | Anionic | Sodium octylphenoxydiethoxyethyl sulfonate | 0* | 0.22 | x | ○ | examples |

(Note) 1.* mark shows that conditions are outside those of the present invention.

As is apparent from Table 2, all Examples Nos. 31 to 43 of the present invention in which nonionic surface active agents or cationic surface active agents of the present invention were used were able to deposit Mg and show excellency in corrosion resistance and plating adhesiveness. In contrast, Comparative Examples Nos. 44 and 45 were unable to deposit Mg and therefore did not show excellent corrosion resistance.

Embodiments 3

Al killed cold rolled steel sheets fabricated in a normal way were used as plating substrate materials. The Al killed cold rolled steel sheets were degreased and pickled, and thereafter, subjected to electroplating using a sulfate bath under the below described conditions. In the plating solution, lauryldimethylbenzylammonium chloride was added as a cationic surface active agent.

Electroplating Conditions

Plating Solution Composition:

| | |
|---|---|
| $ZnSO_4.7H_2O$ | 50~400 g/L |
| $MgSO_4.7H_2O$ | 50~400 g/L |
| $Na_2SO_4$ | 20~100 g/L |
| $H_2SO_4$ | 10~70 g/L |

current density: 30~2000 A/dm$^2$ plating bath temperature: 60±5° C.

plating solution flow rate (V): 0.5~5 m/sec (within the range of V/Vb=0.9~5.0)

plating solution flow rate: 0.5~5 m/sec electrode (anode): $IrO_x$ electrode coating weight: 20 g/m$^2$ Thus obtained plated steel sheets were subjected to a chromate treatment using a reactive chromate treatment solution (Zincrom 359 made by Nippon Parkerizing K.K). Part of the plated steel sheets were subsequently coated with a clear film of 1 $\mu$m Plated steel sheets that had received the chromate treatments were evaluated according to JIS Z2371 Methods of neutral salt spray testing. The evaluation was conducted about white rust generation; for plated steel sheets as chromate-treated, an area ratio of white rust generation at the time of an elapsed time of 72 hours after the test was measured, while for plated steel sheets that had been coated with the clear film after the chromate treatments, an area ratio of white rust generation at the time of an elapsed time of 240 hours after the test was measured, and the measurements were judged according the below described evaluation levels.

White rust resistance evaluation levels

⊙: 0%

○: less than 10%

Δ: equal to or more than 10 and less than 50%

X: 50% or more

Further, crystallographic orientation indexes of Zn—Mg—C composite alloy plated layers were calculated using the above described expression from diffraction intensities of crystallographic planes (002), (100), (101), (102), (103) and (110) of the η phase of Zn measured using an X ray diffraction apparatus. Chromium coating weights were measured using a fluorescence X ray analysis. Coating weights of the Zn—Mg—C composite alloy plated layers were measured by difference of a weight of the plated steel sheet between before and after dissolving the plated layer by a hydrochloric acid, Mg contents were measured using an ICP analysis and C component contents were measured using combustion infrared absorption method.

Thus obtained results are shown in Table 3.

TABLE 3

| No. | Coating weight g/m$^2$ | Mg content wt % | C content wt % | Crystallographic orientation index: Ico (002) | Crystallographic orientation index: Ico (100) | Chromium coating weight mg/m$^2$ | White rust resistance | Clear film, coated or not: |
|---|---|---|---|---|---|---|---|---|
| 1 | 20 | 0.15 | 0.06 | 0.75 | 1.2 | 14 | ⊙ | Not |
| 2 | 20 | 0.18 | 0.09 | 0.81 | 0.54 | 8.4 | ○ | Not |
| 3 | 20 | 0.16 | 0.06 | 0.66 | 0.91 | 16 | ⊙ | Not |
| 4 | 20 | 0.2 | 0.11 | 0.92 | 0.94 | 12 | ⊙ | Coated |
| 5 | 20 | 0.16 | 0.07 | 0.43 | 1.7 | 18 | ⊙ | Not |
| 6 | 20 | 0.21 | 0.09 | 0.88 | 0.48 | 9.2 | ○ | Not |

TABLE 3-continued

| No. | Coating weight g/m² | Mg content wt % | C content wt % | Crystallographic orientation index Ico (002) | Ico (100) | Chromium coating weight mg/m² | White rust resistance | Clear film, coated or not: |
|---|---|---|---|---|---|---|---|---|
| 7 | 20 | 0.23 | 0.11 | 0.35 | 1.52 | 18 | ◎ | Not |
| 8 | 20 | 0.2 | 0.07 | 0.57 | 1.23 | 17 | ◎ | Not |
| 9 | 20 | 0.14 | 0.04 | 1.14 | 0.36 | 6.4 | Δ | Not |
| 10 | 20 | 0.12 | 0.05 | 1.57 | 0.22 | 5.4 | x | Coated |
| 11 | 20 | 0.04 | 0.02 | 2.85 | 0.15 | 4.8 | Δ | Not |
| 12 | 20 | 0.7 | 0.25 | 0.45 | 1.36 | 16 | ◎ | Not |
| 13 | 20 | 1.5 | 0.62 | 0.52 | 1.62 | 15 | ◎ | Not |
| 14 | 20 | 7 | 1.5 | 0.48 | 1.84 | 17 | ◎ | Not |
| 15 | 20 | 15 | 2.3 | 0.24 | 1.54 | 18 | ◎ | Coated |
| 16 | 20 | 32 | 4.7 | 0.36 | 1.21 | 19 | ◎ | Not |
| 17 | 20 | 44 | 8.5 | 0.65 | 0.88 | 16 | ○ | Not |
| 18 | 20 | 1.4 | 12 | 0.47 | 0.96 | 14 | ◎ | Coated |
| 19 | 5 | 0.24 | 0.08 | 0.86 | 0.68 | 13 | ◎ | Not |
| 20 | 5 | 0.3 | 0.18 | 1.22 | 0.54 | 6.1 | x | Not |
| 21 | 5 | 2.8 | 0.59 | 0.75 | 1.37 | 17 | ◎ | Coated |
| 22 | 5 | 14 | 2.7 | 0.43 | 1.65 | 16 | ◎ | Not |
| 23 | 40 | 0.19 | 0.11 | 0.8 | 1.52 | 19 | ◎ | Not |
| 24 | 40 | 1.8 | 0.52 | 1.13 | 0.56 | 4.5 | x | Not |

As is apparent from Table 3, Comparative Examples Nos. 9, 10, 11, 20 and 24 whose plated layer has Ico(002) of higher than 1.0 showed no good white rust resistance. It is understood that referring to Comparative Examples Nos. 2 and 6, excellent white rust resistance is able to be obtained by increasing Ico to 0.6 or higher.

Comparative Examples No. 17 was of Mg content being too high and Comparative Example No. 18 was of C content being too high; both had a problem in regard to plating adhesiveness.

On the other hand, Examples according to the present invention in which Ico(002) was 1.0 or lower and Ico(100) was 0.6 or higher were all exerted excellent white rust resistance.

neutral salt spray testing (JIS Z2371) after cross cuts of depth reaching the substrate surface were formed in respective paints thereon and thereafter, corrosion resistance after painting was investigated by measuring a width of a blister growing from a cross cut on each of the test pieces.

Corrosion resistance after painting evaluation levels

◎: less than 0.5 mm

○: equal to or more than 0.5 and less than 1.0 mm

Δ: equal to or more than 1.0 and less than 1.5 mm

X: 1.5 mm or more

Results are shown in Table 4.

TABLE 4

| No. | Coating weight of Zn—Mg—C g/m² | Mg content wt % | C content wt % | Crystallographic orientation index Ico (002) | Ico (100) | Phosphate coating weight mg/m² | Corrosion resistance |
|---|---|---|---|---|---|---|---|
| 1 | 20 | 0.15 | 0.06 | 0.75 | 1.2 | 1.8 | ◎ |
| 2 | 20 | 0.18 | 0.09 | 0.81 | 0.54 | 1.3 | ○ |
| 3 | 20 | 0.16 | 0.06 | 0.66 | 0.91 | 1.5 | ◎ |
| 4 | 20 | 0.2 | 0.11 | 0.92 | 0.94 | 2.0 | ◎ |
| 5 | 20 | 0.16 | 0.07 | 0.43 | 1.7 | 1.9 | ◎ |
| 6 | 20 | 0.21 | 0.09 | 0.88 | 0.48 | 1.5 | ○ |
| 7 | 20 | 0.23 | 0.11 | 0.35 | 1.52 | 2.1 | ◎ |
| 8 | 20 | 0.2 | 0.07 | 0.57 | 1.23 | 1.9 | ◎ |
| 9 | 20 | 0.14 | 0.04 | 1.14 | 0.36 | 1.1 | Δ |
| 10 | 20 | 0.12 | 0.05 | 1.57 | 0.22 | 1.0 | Δ |
| 11 | 20 | 0.04 | 0.02 | 2.85 | 0.15 | 1.3 | x |

Embodiment 4

Zn—Mg—C composite alloy plated steel sheets were prepared in conditions similar to those in Embodiment 3 and such plated steel sheets were subsequently subjected to a phosphate treatment (Bondelight 3312 made by Nippon Parkerizing K.K) Then, melamine alkyd paint (Magiclon made by Kansai Paint K.K) was applied on the phosphate treated, plated steel sheets to a thickness of 20 μm. Test pieces that had been painted were subjected to 240 hours Examples Nos. 1 to 8 of the present invention, in which (002) was 1.0 or lower and Ico(100) was 0.6 or higher were excellent in corrosion resistance after painting. In contrast, Comparative Examples Nos. 9 to 11, in which Ico(002) was higher than 1.0 and Ico(100) was less than 0.6 were insufficient in corrosion resistance after painting.

Embodiment 5

Zn—Mg—C composite alloy plated steel sheets were prepared in conditions similar to those in Embodiment 3 and such plated steel sheets were subsequently subjected to a silicate treatment which includes lithium silicate and silica as main components to oat the silicate thereon to a thickness after drying and a silicate coating weight was 100 mg/m$^2$ on the basis of Si on each plated steel sheet. Part of the test pieces each were further coated with a clear film to a thickness 1 $\mu$m.

The plated steel sheets that had been treated by the silicate treatment were evaluated similar to as in Embodiment 3. Results are shown in Table 5.

TABLE 5

| No. | Coating weight of Zn—Mg—C g/m$^2$ | Mg content wt % | C content wt % | Crystallographic orientation index Ico (002) | Ico (100) | White rust resistance | Clear film, coated or not: |
|---|---|---|---|---|---|---|---|
| 1 | 20 | 0.15 | 0.06 | 0.75 | 1.2 | ◎ | Not |
| 2 | 20 | 0.18 | 0.09 | 0.81 | 0.54 | ○ | Not |
| 3 | 20 | 0.16 | 0.06 | 0.66 | 0.91 | ◎ | Not |
| 4 | 20 | 0.2 | 0.11 | 0.92 | 0.94 | ◎ | Coated |
| 5 | 20 | 0.16 | 0.07 | 0.43 | 1.7 | ◎ | Not |
| 6 | 20 | 0.21 | 0.09 | 0.88 | 0.48 | ○ | Not |
| 7 | 20 | 0.23 | 0.11 | 0.35 | 1.52 | ◎ | Not |
| 8 | 20 | 0.2 | 0.07 | 0.57 | 1.23 | ◎ | Not |
| 9 | 20 | 0.14 | 0.04 | 1.14 | 0.36 | Δ | Not |
| 10 | 20 | 0.12 | 0.05 | 1.57 | 0.22 | Δ | Coated |
| 11 | 20 | 0.04 | 0.02 | 2.85 | 0.15 | x | Not |
| 12 | 20 | 0.68 | 0.25 | 0.45 | 1.36 | ◎ | Not |
| 13 | 20 | 1.5 | 0.62 | 0.52 | 1.62 | ◎ | Not |
| 14 | 20 | 7 | 1.5 | 0.48 | 1.84 | ◎ | Not |
| 15 | 20 | 15 | 2.3 | 0.24 | 1.54 | ◎ | Coated |
| 16 | 20 | 32 | 4.7 | 0.36 | 1.21 | ◎ | Not |

Examples Nos. 1 to 8 and 12 to 16 of the present invention which Ico(002) was 1.0 or lower and Ico(100) was 0.6 or higher were all exerted excellent white rust resistance. On the other hand, Comparative Examples Nos. 9 to 11 in which Ico(002) was higher than 1 and Ico(100) was lower than 0.6 did not show sufficient white rust resistance.

Embodiment 6

Al killed cold rolled steel sheets fabricated in a normal way were used as plating substrate materials. The Al killed cold rolled steel sheet were plated with Zn—Mg-organic material composite plating while a Mg content and a C content were changed. Further, as Comparative Examples and conventional Examples, some Zn—Mg plated steel sheets were fabricated by electroplating under conditions in which a Mg content and a C content respectively fall outside the ranges of the present invention and some Zn—Mg plated steel sheets were fabricated by vapor deposition plating.

Further, some of test pieces were electroplated while changing a state of island-like deposition of a Zn—Mg-organic material composite plated layer by changing electrolytic conditions and coating weight so as to attain different exposed area ratios of substrate surface. Measurements of exposed area of substrate materials were carried out using EPMA under operating conditions of an acceleration voltage 15 kV, current 0.1 $\mu$A and a color mapping analysis was conducted in a region of 300 $\mu$m×300 $\mu$m. Based on the results of the measurements and analyses, area ratio were calculated by image analysis judging a region with a detection intensity of Fe equal to or higher than 20 kcps as an exposed portion of a substrate material.

Epoxy modified melamine alkyd resin paint for household electric appliances (Delicon 700 made by Dainippon Toryo K.K) was applied on the plated layer of each plated steel sheets using a bar coat method and the paint was baked in a hot air dryer so as to adjust a film thickness to 15 to 25 $\mu$m.

The painted steel sheets thus obtained in the above described process were cut into test pieces of a predetermined size, upper and lower edges of each of the test pieces were protected by tape coverage and thereafter a cross-cut as a physical flaw of depth reaching the substrate surface was formed in the neighborhood of the middle of each of the test pieces. Thereafter, the test pieces were subjected to 500 hours neutral salt spray testing recited in JIS Z2371. Evaluation of corrosion resistance was performed on each test piece by measuring the maximal blister full width from edge to edge and the maximal blister half width from a cross-cut flaw to an edge of one side.

To be concrete, the measurements were judged in score under the following evaluation levels, wherein a score equal to or more than 3 was determined as acceptable.

Corrosion resistance on edges and in physical flaw portions

5: a paint blister width less than 1 mm

4: a paint blister width equal to or more than 1 mm and less than 2 mm

3: a paint blister width equal to or more than 2 mm and less than 3 mm

2: a paint blister width equal to or more than 3 mm and less than 4 mm

1: a paint blister width equal to or more than 4 mm

Evaluation of formability was judged in such a manner that a T0 bending test at 0° C. with an evaluation surface facing outward was performed and cellophane adhesive tape (made by in Nichiban Co. Ltd.) is then attached on a convex surface of a bending portion and peeled off to judge an area of paint film pieces stuck on the tape in a five score method; a score of 5 was given when no peeling off was observed, which showed the best adhesiveness, a score of 1 was given when the coat was fully peeled off, which showed the worst adhesiveness, scores 4 to 2 were assigned as evaluation according to intermediate degrees of peeling-off, wherein a score equal to or more than 3 was determined as acceptable. Evaluation results are shown in Table 6.

TABLE 6

| No. | Plated layer composition: Mg content (mass %) | Plated layer composition: C content (mass %) | Coating weight of Zn—Mg—C g/m$^2$ | Substrate exposed area ratio (%) | Corrosion resistance | Formability | Acceptable or not | Note |
|---|---|---|---|---|---|---|---|---|
| 1 | 0.08 | 0.02 | 10 | 0 | 3 | 4 | OK | Present |
| 2 | 0.11 | 0.03 | 10 | 0 | 3 | 4 | OK | invention |
| 3 | 0.23 | 0.07 | 10 | 0 | 3 | 4 | OK | examples |
| 4 | 0.35 | 0.07 | 10 | 0 | 3 | 4 | OK | |
| 5 | 0.90 | 0.12 | 10 | 0 | 4 | 4 | OK | |
| 6 | 1.5 | 0.20 | 10 | 0 | 4 | 4 | OK | |
| 7 | 6.8 | 1.1 | 10 | 0 | 4 | 4 | OK | |
| 8 | 17 | 3.4 | 10 | 0 | 4 | 3 | OK | |
| 9 | 35 | 7.1 | 10 | 0 | 4 | 3 | OK | |
| 10 | 0.20 | 0.08 | 10 | 8 | 4 | 5 | OK | |
| 11 | 0.18 | 0.08 | 10 | 15 | 4 | 5 | OK | |
| 12 | 0.18 | 0.08 | 9 | 29 | 5 | 5 | OK | |
| 13 | 0.21 | 0.10 | 8 | 52 | 5 | 5 | OK | |
| 14 | 0.20 | 0.09 | 7 | 73 | 5 | 5 | OK | |
| 15 | 0.15 | 0.06 | 4 | 81 | 5 | 5 | OK | |
| 16 | 0.48 | 0.11 | 20 | 10 | 4 | 4 | OK | |
| 17 | 0.63 | 0.15 | 18 | 34 | 5 | 4 | OK | |
| 18 | 0.60 | 0.14 | 15 | 64 | 5 | 5 | OK | |
| 19 | 0.61 | 0.13 | 10 | 79 | 5 | 5 | OK | |
| 20 | 0.04* | 0.13 | 10 | 0 | 1 | 4 | NG | Comparative |
| 21 | 49* | 8.8 | 10 | 0 | 4 | 1 | NG | examples |
| 22 | 0* | 0* | 10 | 0 | 1 | 5 | NG | |
| 23 | 3.8 | 14* | 10 | 0 | 3 | 1 | NG | |
| 24 | 0.51 | 0* | 10 | 0 | 1 | 4 | NG | |
| 25 | 1.0 | 0* | 10 | 0 | 2 | 3 | NG | |
| 26 | 3.5 | 0* | 10 | 0 | 2 | 3 | NG | |
| 27 | 0.21 | 0.07 | 2.5 | 90* | 2 | 4 | NG | |

Examples Nos. 1 to 19 in which a Mg content and a C content were respectively in the ranges of the present invention each showed excellent corrosion resistance in a physical flaw portion and on an edge and good formability as well. Among the examples, Examples Nos. 10 to 19 each of whose substrate exposed area ratio was in the preferable range of the present invention showed more excellent corrosion resistance and formability . On the other hand, Comparative Examples Nos. 20 to 26 in which at least one of a Mg content and a C content falls outside the ranges of the present invention were poor in either corrosion resistance or formability. Further, it is understood that in a case where a substrate exposed area ratio was larger in excess of the range of the present invention, though a Mg and a C content were within the ranges of the present invention, corrosion resistance is inferior to the present invention.

Embodiment 7

Zn—Mg-organic material composite plated steel sheets fabricated in Embodiment 6 were used as substrate materials, and a coating chromate treatment (Zincrom ZM1300D made by Nippon Parkerizing K.K) or a reactive phosphate treatment (SD2500 made by Nippon Paint K.K) was applied to the plated steel sheets. The treatments were adjusted so that in a case of a chromate film, an coating weight in chromium equivalent was 30 mg/m, while in a case of a phosphate film, an coating weight of a film was 1.5 g/m$^2$. It should be appreciated that a spray degreasing treatment using an alkaline solution was conducted prior to the coating chromate treatment and reactive phosphate treatment and in addition to this, in a case of the phosphate treatment, the phosphate treatment was further preceded by a surface adjusting treatment.

In the above described chromate treatment, polyester paint (FLC600 made by Nippon Paint K.K.) was applied on a chromate treated surface by a bar coater as a primer and baked in a hot air dryer so as to be adjusted to a thickness 5 $\mu$m. Polyester paint (FLC900 made by Nippon Paint K.K.) was further applied on the chromate treated surface as a top coat again by a bar coater and baked in a hot air dryer so as to be adjusted to a film thickness 20 $\mu$m.

In the above described phosphate treatment, epoxy modified melamine alkyd resin paint for household electric appliances (Delicon 700 made by Dainippon Toryo K.K) was applied on a phosphate treated surface by a bar coater and baked in a hot air dryer so as to be adjusted to a film thickness 5 to 25 $\mu$m.

The various coated steel sheets in the above described processes were investigated about corrosion resistance in a physical flaw portion and on an edge and formability by means of a method similar to in Embodiment 6. Thus obtained results are shown in Table 7.

TABLE 7

| No. | Plated layer composition: Mg content (mass %) | Plated layer composition: C content (mass %) | Coating weight of Zn—Mg—C g/m$^2$ | Substrate exposed area ratio (%) | Intermediate layer between plated layer and coat*1 | Corrosion resistance | Formability | Acceptable or not | Note |
|---|---|---|---|---|---|---|---|---|---|
| 1 | 0.11 | 0.03 | 10 | 0 | C | 4 | 4 | OK | Present |
| 2 | 0.23 | 0.07 | 10 | 0 | C | 4 | 4 | OK | invention |

TABLE 7-continued

| No. | Plated layer composition Mg content (mass %) | C content (mass %) | Coating weight of Zn—Mg—C g/m$^2$ | Substrate exposed area ratio (%) | Intermediate layer between plated layer and coat*1 | Corrosion resistance | Formability | Acceptable or not | Note |
|---|---|---|---|---|---|---|---|---|---|
| 3 | 0.35 | 0.07 | 10 | 0 | C | 5 | 4 | OK | examples |
| 4 | 1.5 | 0.20 | 10 | 0 | C | 5 | 4 | OK | |
| 5 | 17 | 3.4 | 10 | 0 | C | 5 | 4 | OK | |
| 6 | 0.18 | 0.08 | 10 | 15 | C | 5 | 5 | OK | |
| 7 | 0.18 | 0.08 | 9 | 29 | C | 5 | 5 | OK | |
| 8 | 0.21 | 0.10 | 8 | 52 | C | 5 | 5 | OK | |
| 9 | 0.15 | 0.06 | 4 | 81 | C | 5 | 5 | OK | |
| 10 | 0.63 | 0.15 | 18 | 34 | C | 5 | 5 | OK | |
| 11 | 0.61 | 0.13 | 10 | 79 | C | 5 | 5 | OK | |
| 12 | 0.11 | 0.03 | 10 | 0 | P | 5 | 5 | OK | |
| 13 | 0.23 | 0.07 | 10 | 0 | P | 5 | 5 | OK | |
| 14 | 0.35 | 0.07 | 10 | 0 | P | 5 | 5 | OK | |
| 15 | 1.5 | 0.20 | 10 | 0 | P | 5 | 4 | OK | |
| 16 | 17 | 3.4 | 10 | 0 | P | 5 | 4 | OK | |
| 17 | 0.18 | 0.08 | 10 | 15 | P | 5 | 5 | OK | |
| 18 | 0.18 | 0.08 | 9 | 29 | P | 5 | 5 | OK | |
| 19 | 0.21 | 0.10 | 8 | 52 | P | 5 | 5 | OK | |
| 20 | 0.15 | 0.06 | 4 | 81 | P | 5 | 5 | OK | |
| 21 | 0.63 | 0.15 | 18 | 34 | P | 5 | 5 | OK | |
| 22 | 0.61 | 0.13 | 10 | 79 | P | 5 | 5 | OK | |
| 23 | 0.04* | 0.13 | 10 | 0 | C | 2 | 5 | NG | Comparative |
| 24 | 49* | 8.8 | 10 | 0 | C | 4 | 1 | NG | examples |
| 25 | 0* | 0* | 10 | 0 | C | 2 | 5 | NG | |
| 26 | 3.8 | 14* | 10 | 0 | C | 4 | 1 | NG | |
| 27 | 0.51 | 0* | 10 | 0 | C | 1 | 4 | NG | |
| 28 | 1.0 | 0* | 10 | 0 | C | 2 | 3 | NG | |
| 29 | 3.5 | 0* | 10 | 0 | C | 2 | 3 | NG | |
| 30 | 0.21 | 0.07 | 2.5 | 90* | C | 2 | 4 | NG | |
| 31 | 0.04* | 0.13 | 10 | 0 | C | 2 | 5 | NG | |
| 32 | 49* | 8.8 | 10 | 0 | P | 4 | 2 | NG | |
| 33 | 0* | 0* | 10 | 0 | P | 1 | 5 | NG | |
| 34 | 3.8 | 14* | 10 | 0 | P | 3 | 2 | NG | |
| 35 | 0.51 | 0* | 10 | 0 | P | 1 | 4 | NG | |
| 36 | 1.0 | 0* | 10 | 0 | P | 2 | 3 | NG | |
| 37 | 3.5 | 0* | 10 | 0 | P | 2 | 3 | NG | |
| 38 | 0.21 | 0.07 | 2.5 | 90* | P | 2 | 5 | NG | |

*1: C = chromate treatment,
P = phosphate treatment

From Table 7, it is understood that Examples Nos. 1 to 22 in which a Mg content and a C content in a plated layer are in the ranges of the present invention show excellent corrosion resistance and formability in either of cases of a chromate film and a phosphate film are respectively inserted as an intermediate layer between a plated layer and a coat. On the other hand, from Table 7 as well, it is understood that in a case where either a Mg content or a C content in a plated layer, or a substrate exposed area ratio falls outside the ranges of the present invention, both of sufficient corrosion resistance and formability cannot simultaneously be ensured even if either a chromate film or a phosphate film is applied.

Embodiment 8

Similar to Embodiment 6, Al killed cold rolled steel sheets fabricated in a normal way were used as substrate materials to fabricate Zn—Mg-organic material composite plated steel sheets that each have a Mg content of 0.25 wt %, a C content of 0.15 wt % and a coating weight in the range of from 0.2 to 58 g/m$^2$. Further, Zn electroplated steel sheets in each of which a coating weight was almost in the same range as the above described one were fabricated as comparative materials.

Similar to in Embodiment 7, a coating chromate treatment was applied on each of the plated steel sheets, a primer coating was further applied thereon and a top coat was formed on the primer.

Corrosion resistance in a physical flaw portion and on an edge and formability was investigated on each of thus obtained coated steel sheets. Results are shown in Table 8.

TABLE 8

| No. | Plated layer Plated kind*1 | Coating weight g/m$^2$ | Substrate exposed area ratio (%) | Corrosion resistance | Formability | Acceptable or not | Note |
|---|---|---|---|---|---|---|---|
| 1 | ZMC | 0.6 | 80 | 3 | 5 | OK | Present |
| 2 | ZMC | 1.3 | 73 | 4 | 5 | OK | invention |

TABLE 8-continued

| No. | Plated layer: Plated kind*[1] | Plated layer: Coating weight g/m$^2$ | Plated layer: Substrate exposed area ratio (%) | Corrosion resistance | Formability | Acceptable or not | Note |
|---|---|---|---|---|---|---|---|
| 3 | ZMC | 3.2 | 61 | 5 | 5 | OK | examples |
| 4 | ZMC | 8.1 | 28 | 5 | 5 | OK | |
| 5 | ZMC | 17 | 15 | 5 | 5 | OK | |
| 6 | ZMC | 28 | 8 | 5 | 4 | OK | |
| 7 | ZMC | 35 | 5 | 5 | 4 | OK | |
| 8 | ZMC | 0.2* | 82 | 2 | 4 | NG | Comparative |
| 9 | ZMC | 58* | 3 | 5 | 1 | NG | examples |
| 10 | EG | 0.5 | 0 | 1 | 5 | NG | Conventional |
| 11 | EG | 2.1 | 0 | 1 | 5 | NG | example |
| 12 | EG | 3.8 | 0 | 1 | 5 | NG | |
| 13 | EG | 9.0 | 0 | 2 | 5 | NG | |
| 14 | EG | 20 | 0 | 2 | 5 | NG | |
| 15 | EG | 31 | 0 | 2 | 5 | NG | |

*[1]: ZMC = Zn—Mg-organic, EG = Electrogalvanized

Understandings from Table 8 are as follows: All of Examples Nos. 1 to 7 that are of Zn—Mg-organic material plated steel sheets each with a paint, each of which has a coating weight in the range of the present invention, show excellent corrosion resistance and formability. On the other hand, Comparative examples Nos. 8 and 9 each of which has a coating weight of Zn—Mg-organic material plated layer outside the range of the present invention show corrosion resistance and formability inferior to those of Examples Nos. 1 and 7. Further, Conventional examples Nos. 10 to 15 whose plated layer are formed by electrogalvanizing show extremely poor corrosion resistance at all levels of a coating weight.

Since the present invention is constituted as described above, the present invention can provide a Zn—Mg alloy plated metal sheet excellent in corrosion resistance, formability and productivity and a fabrication process therefor. Especially, a plated metal sheet of the present invention has corrosion resistance more excellent than any kind of conventional surface treated metal materials and has further excellent formability of a plated film thereof. Further advantages are such that fabrication of a plated metal sheet of the present invention is excellent in control of operating conditions: not only can a chemical composition and a coating weight of a plated layer be controlled with ease, but metal ions is also easily supplied during plating, thereby entailing excellent continuity of operation. Still further advantage comes from the fact that a fabrication cost is lower than in Zn—Mg alloy vapor deposition plating and so on.

What is claimed is:

1. A Zn—Mg electroplated metal substrate comprising:

a metal substrate, and a C component-containing Zn—Mg electroplated layer comprising C, Mg and Zn, wherein Zn is a main component, formed on at least one surface of said metal substrate, wherein said metal substrate is electroplated in an acidic aqueous solution comprising at least one metal salt of Zn and at least one metal salt of Mg and one or more surface active agents which comprise at least one of a cationic surface active agent and a nonionic surface active agent, and said C component is an organic compound produced from said one or more surface active agents, and wherein the Mg content in the Zn—Mg electroplated layer is in the range of from 1 to 40 wt %.

2. A Zn—Mg electroplated metal substrate according to claim 1, wherein the C component content in the Zn—Mg electroplated layer is in the range of from 0.01 to 10 wt % on the basis of the C element.

3. A Zn—Mg electroplated metal substrate according to claim 1, wherein a chemical treatment film is formed on the Zn—Mg electroplated layer.

4. A Zn—Mg electroplated metal substrate according to claim 1, wherein a crystallographic orientation index of the (002) plane of the Zn—Mg electroplated layer is equal to or lower than 1.0 and a chemical treatment film is formed on the Zn—Mg electroplated layer.

5. A Zn—Mg electroplated metal substrate according to claim 1, wherein a crystallographic orientation index of the (100) plane of the Zn—Mg electroplated layer is equal to or higher than 0.6 and a chemical treatment film is formed on the Zn—Mg electroplated layer.

6. A Zn—Mg electroplated metal substrate according to claim 1, wherein a crystallographic orientation index of the (002) plane of the Zn—Mg electroplated layer is equal to or lower than 1.0, a crystallographic orientation index of the (100) plane of the Zn—Mg electroplated layer is equal to or higher than 0.6 and a chemical treatment film is formed on the Zn—Mg electroplated layer.

7. A Zn—Mg electroplated metal substrate according to claim 1, wherein one or multiple layers of paint film are formed on the Zn—Mg electroplated layer.

8. A Zn—Mg electroplated metal substrate according to claim 1, wherein said substrate is a sheet, and wherein the Zn—Mg electroplated layer covers a portion of said metal sheet and is surrounded by an area which is not electroplated with said Zn—Mg layer and wherein one or multiple layers of a paint film are formed on the Zn—Mg electroplated layer.

9. A Zn—Mg electroplated metal substrate according to claim 1, wherein said substrate is a sheet, and wherein the Zn—Mg electroplated layer covers a portion of the surface of said metal sheet and is surrounded by an area that is not electroplated with said Zn—Mg layer, wherein the surface area of said metal sheet which is not covered with the Zn—Mg deposition is in the range of from 5 to 85% in area ratio and wherein one or multiple layers of paint film are formed on the Zn—Mg electroplated layer.

10. A Zn—Mg electroplated metal substrate according to claim 1, wherein a chemical treatment film is formed on the Zn—Mg electroplated layer and one or multiple layers of paint film are formed on the chemical treatment film.

11. A Zn—Mg electroplated metal substrate according to claim 1, wherein a chromate film or a phosphate film is formed on the Zn—Mg electroplated layer and one or multiple layers of paint film are formed on the chromate film or the phosphate film.

12. A Zn—Mg electroplated metal substrate of claim 1 wherein the one or more surface active agents comprises a cationic surface active agent.

13. A Zn—Mg electroplated metal substrate of claim 1 wherein the one or more surface active agents comprises a nonionic surface active agent.

14. A Zn—Mg electroplated metal substrate of claim 1 that has a crystallographic orientation index of the (002) plane of the electroplated layer equal to or lower than 1.0 or a crystallographic orientation index of the (100) plane of an electroplated layer equal to or higher than 0.6, or both.

15. A Zn—Mg electroplated metal substrate of claim 1 in the form of a sheet, a corrugated sheet, a pipe, or a rod.

16. A construction material, electrical appliance or automobile comprising the Zn—Mg electroplated metal substrate of claim 1.

17. A process for producing the Zn—Mg electroplated metal substrate according to claim 1, comprising: electroplating said metal substrate in said acidic aqueous solution.

18. The process according to claim 17 wherein said electroplating crystallographic orientation of the electroplated layer to increase chemical treatability of the electroplated layer.

19. The process of claim 17 wherein the one or more surface active agents comprises a cationic surface active agent.

20. The process of claim 17 wherein the one or more surface active agents comprises a nonionic surface active agent.

* * * * *